US011369813B2

(12) United States Patent
Hansen

(10) Patent No.: US 11,369,813 B2
(45) Date of Patent: Jun. 28, 2022

(54) INTEGRATED MANIFOLD SYSTEM

(71) Applicant: Special Projects Operations, Inc., Belcamp, MD (US)

(72) Inventor: Brennan E. Hansen, Chesapeake, VA (US)

(73) Assignee: SPECIAL PROJECTS OPERATIONS, INC., Belcamp, MD (US)

( * ) Notice: Subject to any disclaimer, the term of this patent is extended or adjusted under 35 U.S.C. 154(b) by 829 days.

(21) Appl. No.: 16/137,847

(22) Filed: Sep. 21, 2018

(65) Prior Publication Data

US 2019/0091497 A1 Mar. 28, 2019

Related U.S. Application Data

(60) Provisional application No. 62/563,714, filed on Sep. 27, 2017.

(51) Int. Cl.
*A62B 9/04* (2006.01)
*A62B 9/02* (2006.01)
(Continued)

(52) U.S. Cl.
CPC ..... *A62B 9/04* (2013.01); *A62B 7/02* (2013.01); *A62B 9/02* (2013.01); *B63C 11/2209* (2013.01);
(Continued)

(58) Field of Classification Search
CPC .... A62B 9/04; A62B 9/02; A62B 7/04; A62B 7/02; A62B 7/00; A62B 9/00; B63C 11/2209; B63C 11/02; B63C 2011/2218; B63C 11/2227; B63C 11/2236; B63C 11/22; F16L 41/03; A61M 16/20; F17C 2270/025; F17C 2205/0146; F17C 2205/0338; F17C 13/04
See application file for complete search history.

(56) References Cited

U.S. PATENT DOCUMENTS 764,709 A * 7/1904 Chapin et al. ..... A62B 7/02 128/205.22
914,576 A * 3/1909 Jaubert ..... A61M 16/00 128/204.18
(Continued)

FOREIGN PATENT DOCUMENTS

EP 112765 7/1984

OTHER PUBLICATIONS

International Search Report issued in PCT/US2018/052156 dated Jan. 16, 2019.
(Continued)

*Primary Examiner* — Tu A Vo
(74) *Attorney, Agent, or Firm* — Whiteford, Taylor & Preston, LLP; Gregory M. Stone

(57) ABSTRACT

A one-piece, machined manifold for connecting air supply cylinders with a first stage regulator and recharge port has at least one bottle port configured to removably receive a bottle of pressurized air, a first stage regulator chamber, a quick disconnect fitting port, an air channel in fluid communication with the at least one bottle port and the first stage regulator chamber, and an outlet channel in fluid communication with the first stage regulator chamber.

24 Claims, 7 Drawing Sheets

(51) Int. Cl.
*B63C 11/22* (2006.01)
*A62B 7/02* (2006.01)
*F17C 13/04* (2006.01)

(52) U.S. Cl.
CPC ..... *F17C 13/04* (2013.01); *F17C 2205/0146* (2013.01); *F17C 2205/0338* (2013.01); *F17C 2270/025* (2013.01)

(56) References Cited

U.S. PATENT DOCUMENTS 2,310,021 A * 2/1943 Heidbrink ..... A61M 16/104 128/204.18
2,380,956 A * 8/1945 Evarts ..... F17C 13/045 137/113
2,406,888 A * 9/1946 Meidenbauer, Jr. ..... A62B 7/02 128/205.24
3,433,222 A * 3/1969 Pinto ..... B63C 11/26 128/201.24
3,583,433 A 6/1971 Lecocq
D236,724 S 9/1975 Scheffler et al.
D240,427 S 7/1976 Ikonen et al.
D241,756 S 10/1976 Gray
4,009,583 A * 3/1977 Buckle ..... B63C 11/2245 405/186
4,062,356 A * 12/1977 Merrifield ..... A62B 7/04 128/205.22
4,264,036 A 4/1981 Moore
D273,804 S 5/1984 Fueloep
4,722,333 A * 2/1988 Bartos ..... A62B 7/00 128/202.27
4,794,922 A * 1/1989 DeVries ..... A61M 16/024 128/204.18
4,800,923 A * 1/1989 Bartos ..... A62B 7/00 137/613
D305,147 S 12/1989 Samford
5,048,565 A 9/1991 Oi
5,123,442 A 6/1992 Geuy et al.
5,186,209 A 2/1993 McManigal et al.
D343,888 S 2/1994 Rupp
D354,799 S 1/1995 Self
D360,017 S 7/1995 Lopez
5,440,477 A 8/1995 Rohrberg et al.
5,584,289 A * 12/1996 Wise ..... A62B 9/04 128/205.22
5,676,589 A 10/1997 Ashworth
6,105,632 A 8/2000 Buhlmann
D489,794 S 5/2004 Storer et al.
7,380,551 B2 6/2008 Alvey
7,543,584 B2 6/2009 Brookman
7,658,190 B1 2/2010 Phifer et al.
7,766,038 B2 8/2010 Geddes et al.
8,056,577 B2 11/2011 Street
8,814,067 B2 8/2014 Freers et al.
D728,755 S 5/2015 Nasu
D735,307 S 7/2015 Magana
9,375,679 B2 6/2016 Adams et al.
D767,736 S 9/2016 Nasu
9,557,108 B2 1/2017 Freers et al.
2004/0182394 A1 9/2004 Alvey et al.
2004/0182395 A1 9/2004 Brookman
2005/0022817 A1 2/2005 Alvey
2005/0109341 A1 5/2005 Alvey
2006/0048777 A1 3/2006 Brookman
2006/0191533 A1 8/2006 Brookman et al.
2007/0215209 A1* 9/2007 Street ..... F17C 5/06 137/263
2007/0235030 A1* 10/2007 Teetzel ..... A62B 18/02 128/205.12
2008/0271796 A1* 11/2008 Neumann ..... F17C 5/06 137/606
2009/0101215 A1* 4/2009 Colby ..... F41B 11/73 137/505.42
2012/0067348 A1 3/2012 Steck et al.
2013/0333704 A1 12/2013 Duncan
2014/0345609 A1 11/2014 Whitcher et al.
2014/0366873 A1 12/2014 Robey
2015/0283409 A1* 10/2015 Buck ..... A62B 7/10 128/204.22
2016/0008639 A1 1/2016 MacLeod
2017/0123439 A1 5/2017 Koenig
2017/0198827 A1 9/2017 Rado

OTHER PUBLICATIONS

Extended European Search Report issued in co-pending European Application No. 18863608.8 dated May 11, 2021.

* cited by examiner

SECTION B-B

SECTION C-C

INTEGRATED MANIFOLD SYSTEM

CROSS REFERENCE TO RELATED APPLICATION

This application claims the benefit of U.S. Provisional Application No. 62/563,714 titled "Integrated Manifold System," filed Sep. 27, 2017 by the inventor herein, which application is incorporated herein by reference in its entirety.

FIELD OF THE INVENTION

This invention relates to systems and devices for the pressure-regulated supply of gases, and more particularly to a system and device providing a pressure-regulated supply of pressurized, breathable air, oxygen, or other gases in a compact, light-weight assembly.

BACKGROUND OF THE INVENTION

First responders, members of the military, emergency personnel, and others are frequently confronted with inhospitable breathing environments, such as may occur in the event of fire, a hazardous chemical spill, a nuclear, chemical, or biological attack, or the like. In order to allow such personnel to accomplish their mission in such environment, various systems have been developed to provide the individual with personal breathing apparatus that ensures them of a clean, safe breathing environment, even when operating in the hostile environment. However, such operators are often placed under significant physical and other stress when operating in those environments, and are often confronted with small or obstructing spaces in which to operate. While previously known systems have been able to provide the operators secure breathing environments, their bulky size has made operation in highly stressful and/or obstructive environments quite challenging. Thus, there remains a need in the art to provide a system and apparatus that can reliably provide a safe, secure breathing environment but that minimizes the overall profile (i.e., physical size and weight) of the system so as to ease the stress on the operator during use.

SUMMARY OF THE INVENTION

Disclosed herein is an integrated manifold system, usable for instance in self-contained breathing applications, that combines in a single, compact, unitary assembly a one-piece, machined manifold for connecting air supply cylinders with a first stage regulator and recharge port, providing a significant improvement over previously known systems, as it reduces potential points of failure in the system, reduces overall weight of the system, and eases the burden on the operator by not requiring them to carry and keep track of multiple, separate components for these features. While the exemplary embodiment described herein is principally with reference to the delivery of breathable air to an operator in an environmentally hazardous application, the system may likewise be used, by way of non-limiting example, to provide pressure-regulated delivery of high pressure, pure oxygen, such as might be desirable in medical procedures for delivering oxygen to a patient, in exothermic breaching applications using exothermic torch devices that employ oxygen, and such other applications that my require the portable delivery of pressure-regulated gases as will occur to those skilled in the art.

In accordance with certain aspects of an embodiment of the invention, an air supply system is disclosed comprising:

a one-piece manifold body having at least one bottle port configured to removably receive a bottle of pressurized air, a first stage regulator chamber, a quick disconnect fitting port, an air channel in fluid communication with the at least one bottle port and the first stage regulator chamber, and an outlet channel in fluid communication with the first stage regulator chamber.

In accordance with further aspects of an embodiment of the invention, an air supply system is disclosed comprising: a one-piece manifold body having at least one bottle port configured to removably receive a bottle of pressurized air, a first stage regulator chamber, a quick disconnect fitting port, an air channel in fluid communication with the at least one bottle port and the first stage regulator chamber, and an outlet channel in fluid communication with the first stage regulator chamber; a first stage regulator operatively engaging the first stage regulator chamber; a mask hose quick disconnect in fluid communication with the outlet channel and configured to removably receive an air hose; and an on/off valve operatively engaging the air channel to regulate air flow between the at least one bottle port and the first stage regulator.

BRIEF DESCRIPTION OF THE DRAWINGS

The accompanying drawings, which are included to provide further understanding of the invention and are incorporated in and constitute a part of this specification, illustrate embodiments of the present invention and together with the below description, serve to explain the principles of the invention.

DETAILED DESCRIPTION OF THE PREFERRED EMBODIMENTS

The invention summarized above may be better understood by referring to the following description, claims, and accompanying drawings. This description of an embodiment, set out below to enable one to practice an implementation of the invention, is not intended to limit the preferred embodiment, but to serve as a particular example thereof. Those skilled in the art should appreciate that they may readily use the conception and specific embodiments disclosed as a basis for modifying or designing other methods and systems for carrying out the same purposes of the present invention. Those skilled in the art should also realize that such equivalent assemblies do not depart from the spirit and scope of the invention in its broadest form.

Figures 1, 1A:
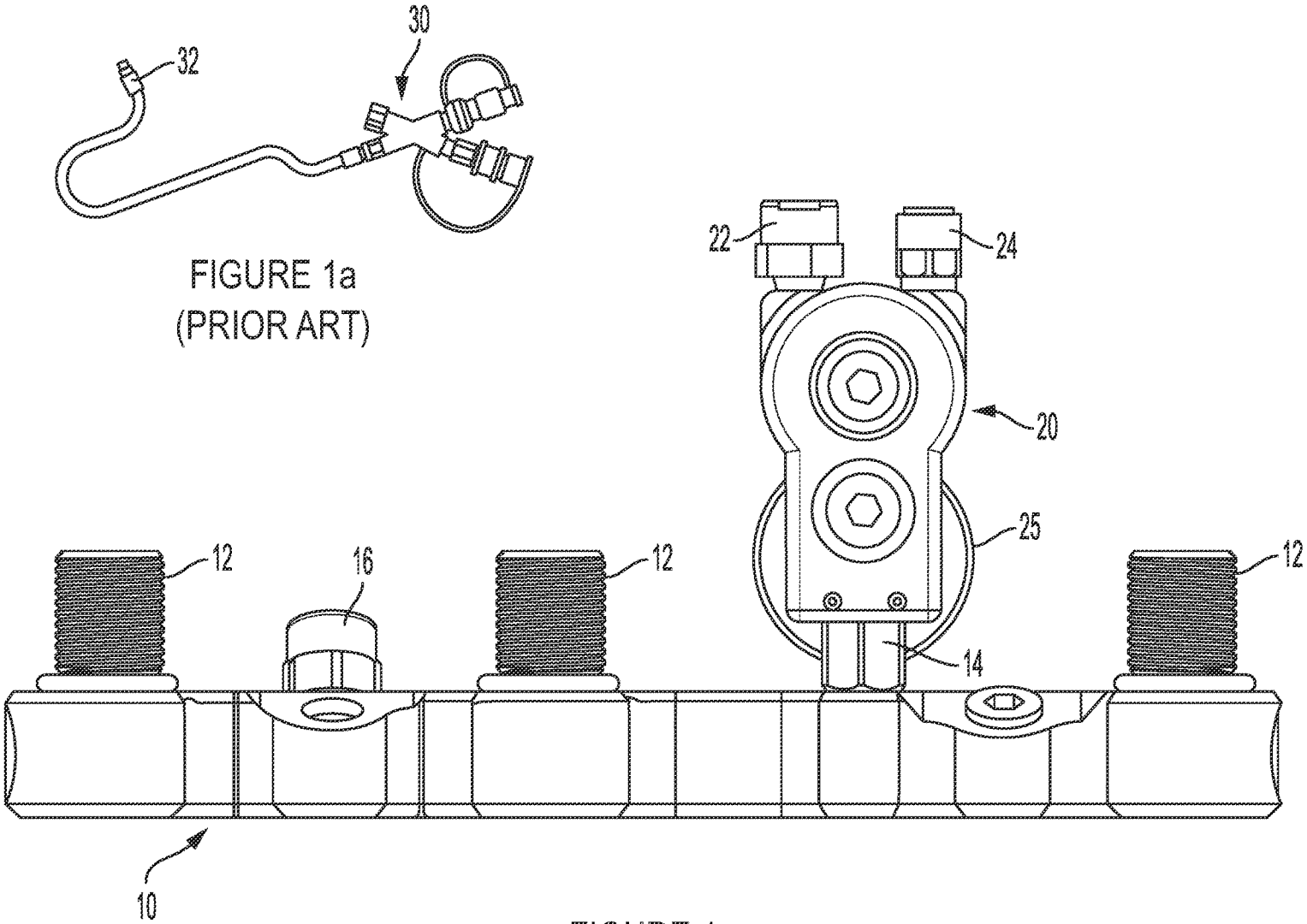
FIGURE 1a (PRIOR ART)
FIGURE 1 (PRIOR ART)
FIGS. 1 and 1(*a*) show front views of a prior art, multi-piece manifold for attaching air cylinders with the separate elements of a first stage regulator and recharge assembly, respectively.

FIG. 1 shows a prior art manifold system 10 for connecting high pressure air bottles (not shown) to a first stage regulator 20, which first stage regulator 20 in turn delivers air to a second stage regulator on an operator's mask (not shown), such as a gas mask. Manifold 10 includes bottle ports 12 that removably receive high pressure air bottles or canisters, which deliver air through an internal port to a regulator adapter 14 that removably receives a first stage regulator 20. First stage regulator 20 typically includes a low pressure hose attachment 22 for delivering air pressure through a hose to the operator's mask, and a low pressure relief valve 24 to allow an operator to regulate the amount of pressure delivered to their mask and/or to allow air exceeding a desired pressure to be bled from the regulator 20. First stage regulator 20 also typically includes an on/off valve 25 that controls delivery of air from regulator adapter 14 into first stage regulator 20. Manifold 10 typically includes a high pressure relief valve 16 that is attached to manifold 10 with yet another separate fitting to allow emergency release of air pressure from the system. Moreover, in order to recharge canisters attached to manifold 10, a separate recharge assembly 30 must be provided and carried by the operator. Such recharge assembly 30 includes a hose fitting 32 that must be fitted to yet another fitting (not shown) on manifold 10 in order to allow refill of air canisters attached to manifold 10 through cylinder ports 12.

Such prior art assemblies have disadvantages for the operator, particularly when working in high-stress environments, as well as for the manufacturer or supplier of such systems. The various adapters necessary for attachment of the first stage regulator 20, the high pressure relief valve 16, and the recharge port 30 all create potential points of failure, and overall add weight to the system that the operator must carry. Moreover, such varied components add unnecessary complexity to the system which increases costs in materials and manufacturing.

Figure 2:
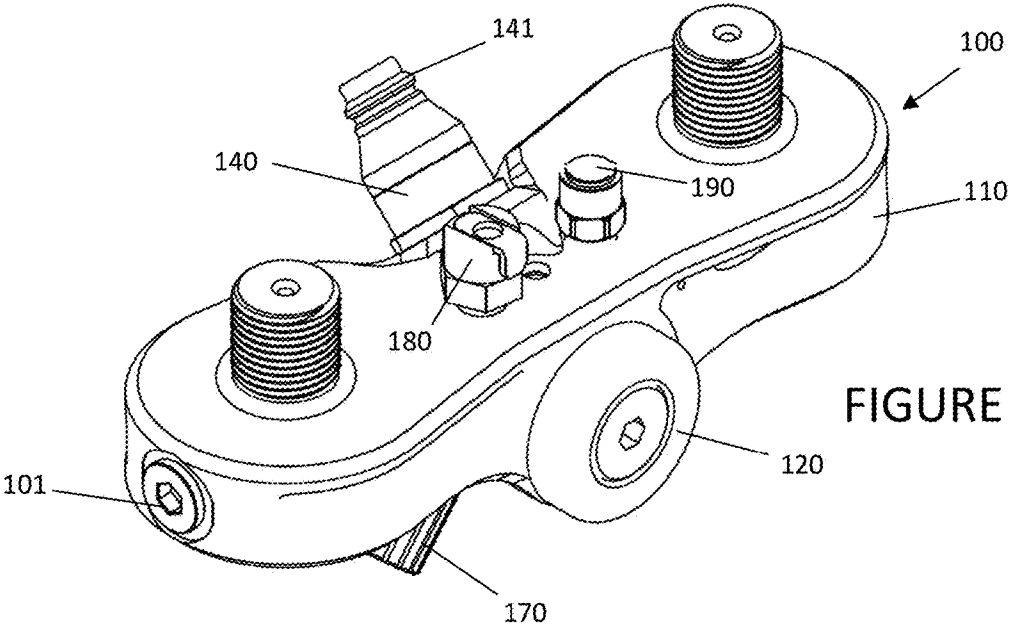
FIG. 2 illustrates a perspective view of an integrated manifold system in accordance with certain aspects of an embodiment of the invention.
Figure 4:
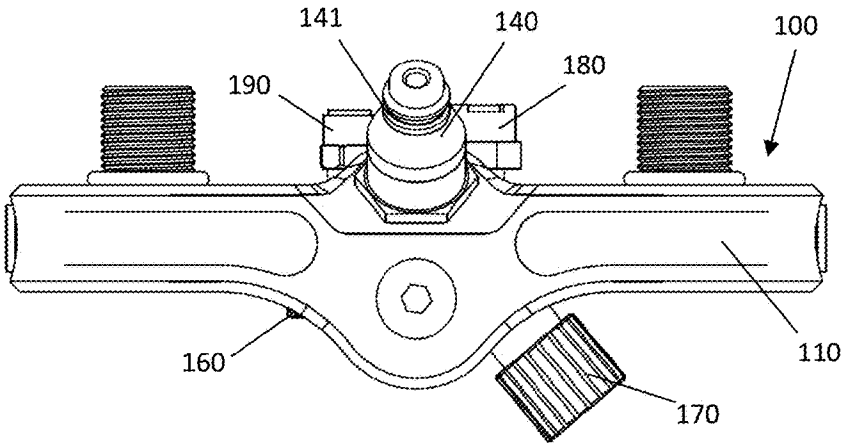
FIG. 4 illustrates a back view of the integrated manifold system of FIG. 2.
Figure 3:
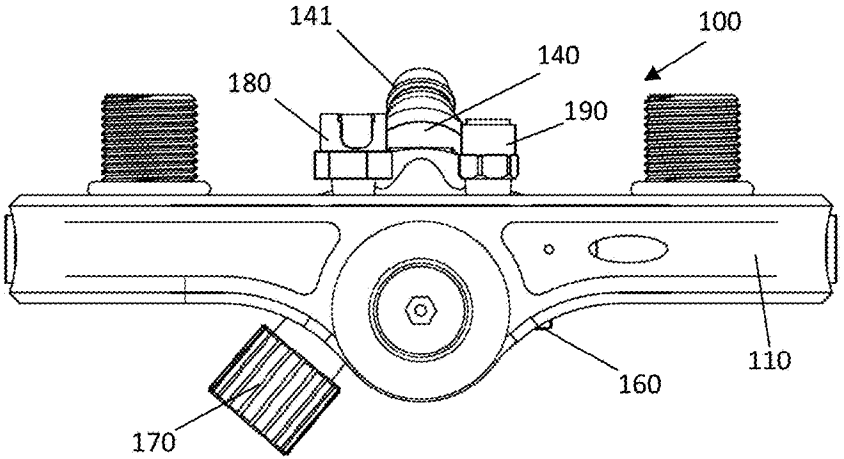
FIG. 3 illustrates a front view of the integrated manifold system of FIG. 2.

FIGS. 2, 3, and 4 show top perspective, front, and back views, respectively, of an improved manifold system 100 in accordance with certain aspects of an embodiment of the invention, which integrates a first stage regulator 120, a male quick disconnect 140 for recharging bottles attached to manifold system 100 and for providing an alternative source of air to manifold system 100, a high pressure relief valve 160, an on/off valve 170, a low pressure hose attachment 180, and a low pressure relief valve 190 all in a single, unitary manifold body 110. Such assembly significantly improves upon previously known assemblies by dramatically decreasing the number of adapter and integration fittings required for assembly of the foregoing components, and by making the entire assembly lighter and smaller (and thus of less physical load on the operator), while likewise improving quality control and assembly time by having fewer potential points of failure.

Figure 5:
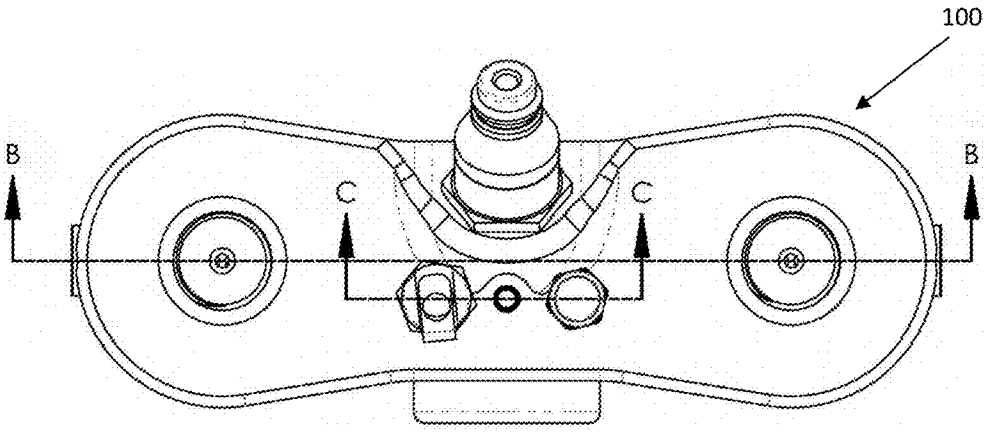
FIG. 5 illustrates a top view of the integrated manifold system of FIG. 2.

With continued reference to FIGS. 2-4, the top view of manifold system 100 of FIG. 5, and the various cross-sectional views of manifold system 100 of FIGS. 6-9, manifold body 110 is a single, unitary (i.e., one piece) assembly. In a particularly preferred embodiment, manifold body 110 may be milled out of billet aluminum. In other configurations, such as when manifold 100 is intended for use in the pressure-regulated delivery of high pressure oxygen, manifold 100 may be milled out of brass, titanium, or such other materials as may be best suited to a particular application, as may be selected by persons skilled in the art. Manifold body 110 includes bottle ports 112 that removably receive readily commercially available air cylinders (not shown) of standard configuration, which cylinders are available from a variety of manufactures. With particular reference to the cross-sectional view of FIG. 7*a* (along section line A-A of FIG. 6) showing manifold body 110 with all other elements removed, manifold body 110 is milled to form a first stage regulator chamber 114 extending from a front side 110*a* of manifold body 110, through manifold body 110 and to a back side 110*b* of manifold body 110, which first stage regulator chamber 114 is shaped to receive first stage regulator 120. Manifold body 110 is further milled to form a quick disconnect fitting port 115 configured to removably receive, such as by way of a threaded connection, male quick disconnect 140, and a high pressure feed port 116 that fluidly communicates quick disconnect fitting port with 115 with first stage regulator chamber 114. Still further, manifold body 110 is milled to form on/off valve receiver 117 configured to removably receive, such as by way of a threaded connection, on/off valve 170. On/off valve receiver 117 is in fluid communication with high pressure air channel 113, such that (as discussed in greater detail below and with reference to FIG. 10) on/off valve 170 in on/off valve receiver 117 is operative to control air flow from high pressure air channel 113 into a head space 117*a* (FIG. 6) at the top end of on/off valve receiver 117. Head space 117*a* of on/off valve receiver 117 is also in fluid communication with quick disconnect fitting port 115 via inlet 115*a*, such that when on/off valve 170 is open, air flows from air bottles attached to bottle ports 112, through high pressure air channel 113, into head space 117*a* of on/off valve receiver 117, and out of head space 117*a* through inlet 115*a* into quick disconnect fitting port 115. From quick disconnect fitting port 115, high pressure air is then delivered through high pressure feed port 116 into first stage regulator chamber 114, and as discussed in greater detail below, is ultimately delivered from first stage regulator chamber 114 through outlet channel 118 (FIG. 8) which is likewise milled into manifold body 110. An outer end of outlet channel 118 is configured to receive low pressure hose attachment 180 for delivering air from manifold system 100 to a user's mask. Preferably, a relief valve channel 119 is also milled into manifold body 110 and is similarly in communication with first stage regulator chamber 114, and receives low pressure relief valve 190 at an outer end of relief valve channel 119.

Figure 9:
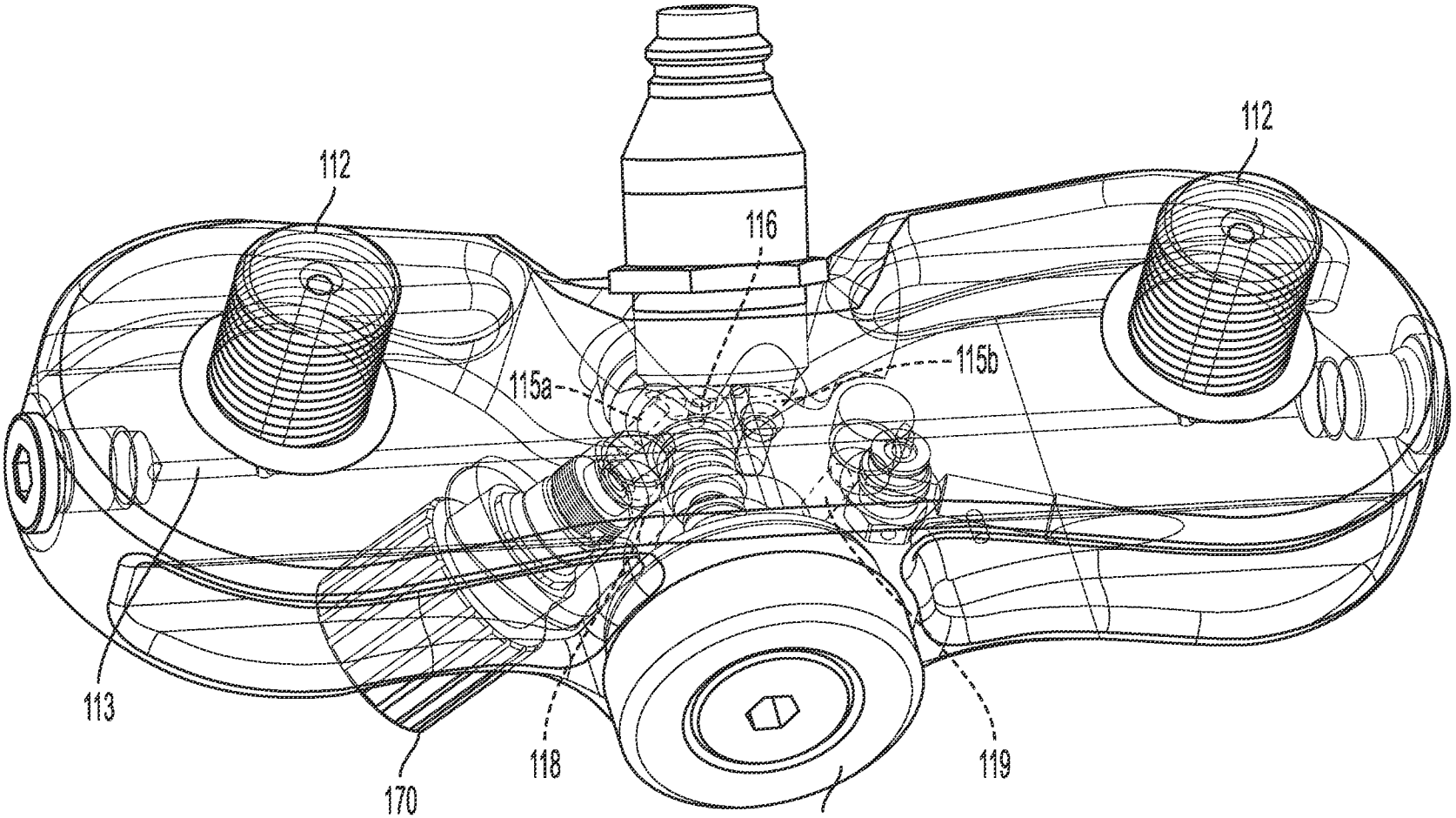
FIG. 9 is a perspective view of the integrated manifold system of FIG. 2 with the manifold body shown in phantom.
Figure 10:
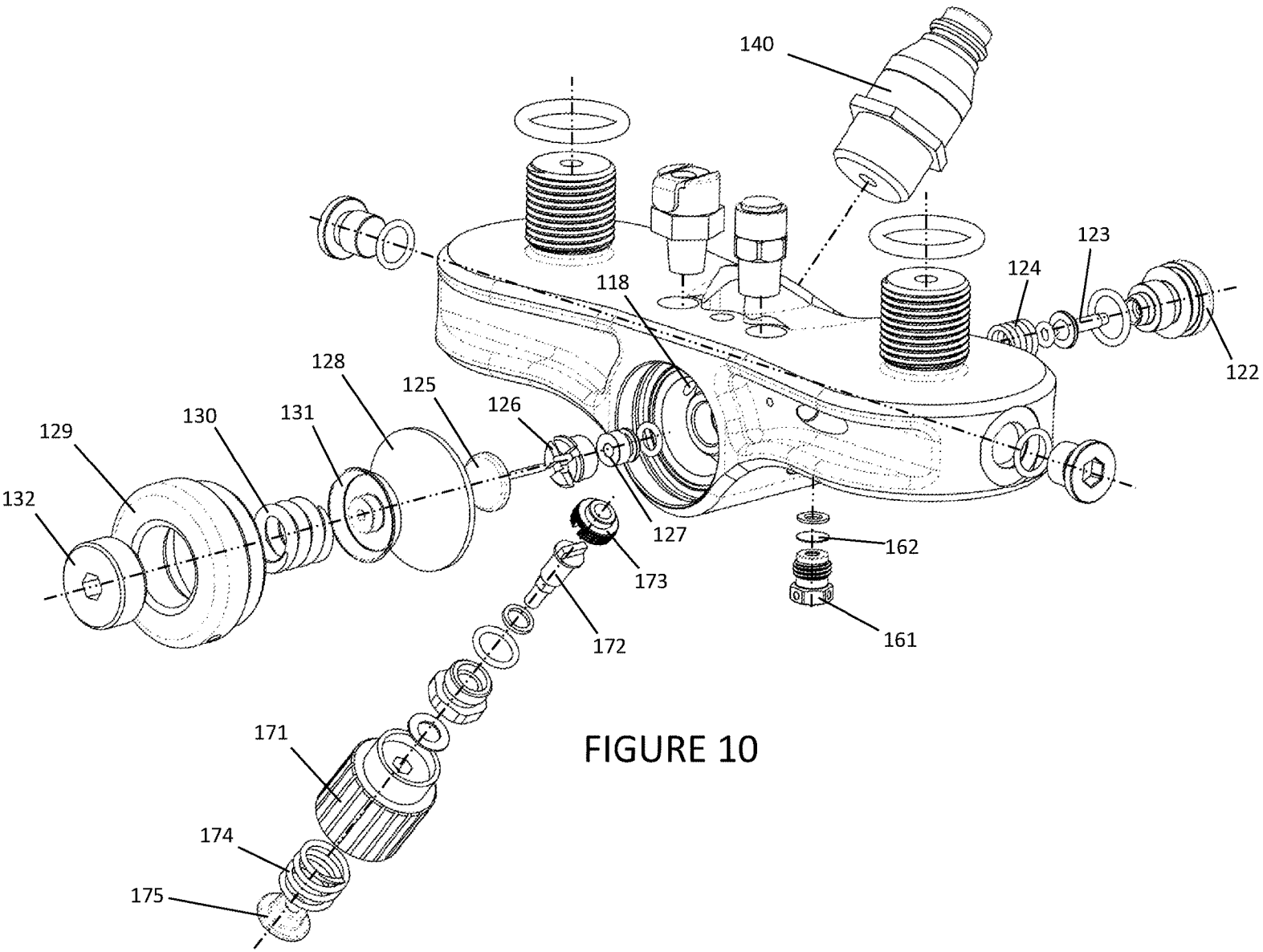
FIG. 10 is an exploded view of the integrated manifold system of FIG. 2.

As mentioned above, and with particular reference to FIGS. 6 and 9 and the exploded view of FIG. 10, on/off valve 170 controls the flow of air from high pressure air channel 113 to quick disconnect fitting port 115. In that regard, on/off valve 170 includes a manually operable hand wheel 171, a valve stem 172, and a plug 173 engaged by valve stem 172 to open and close port 113*a* that communicates high pressure air channel 113 with head space 117*a*. Plug 173 is biased by spring 174 (the biasing force of which is adjustable via nut 175) towards closure of port 113*a*, with the closing force being adjustable by turning hand wheel 171 so as to allow pressurized air to flow from high pressure air channel 113, into head space 117*a*, and through inlet 115*a* to quick disconnect fitting port 115. In certain embodiments, on/off valve receiver 117 preferably forms a downwardly angled opening in manifold body 110, which positions hand wheel 171 for access by an operator from the underside of manifold body 110, extending downward and to one side of manifold body 110 to allow easy access to an operator when reaching around their body to control the manifold system 100, without requiring the operator to remove the system from their back to turn the system on and off.

Thus, when on/off valve 170 is opened, full bottle pressure is introduced from bottle ports 112 into air channel 113, to head space 117*a*, through inlet 115*a* into quick disconnect fitting port 15, and from disconnect fitting port 15 through high pressure feed port 121 into first stage regulator 120.

Figure 6:
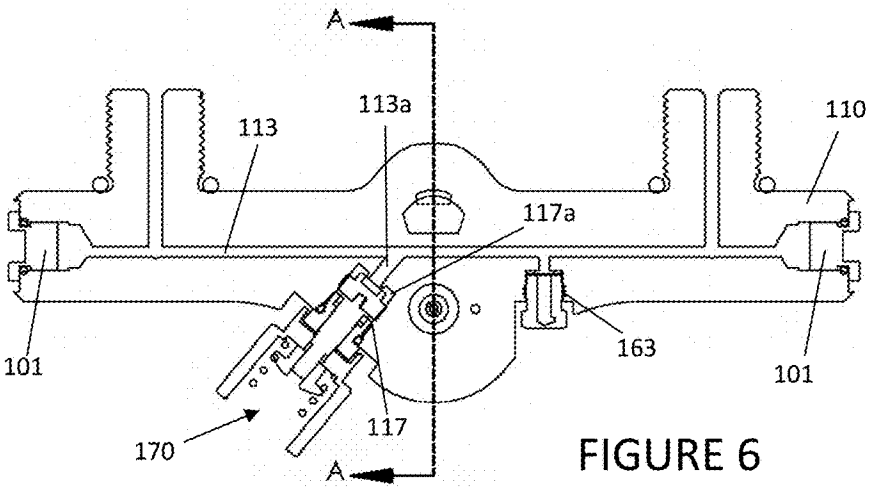
FIG. 6 is a cross-sectional view of the integrated manifold system of FIG. 5 along section line B-B.

With continued reference to FIGS. 6, 9, and 10, high pressure relief valve 160 is provided in an underside of manifold body 110. High pressure relief valve 160 includes a burst plug 161 and a burst safety disc 162 in fluid communication with high pressure air channel 113. In certain embodiments, high pressure relief valve receiver 163 is milled into a bottom face of manifold body 110 on an opposite side of first stage regulator 120 from on/off valve receiver 117 and extends vertically from the bottom face of manifold body 110 into high pressure air channel 113, and removably receives (such as by way of non-limiting example via a threaded connection) high pressure relief valve 160 therein. This configuration positions high pressure relief valve 160 largely within the profile of manifold body 110 so as to avoid unnecessary obstructions on the exterior of manifold system 100. In the event of an overpressure condition occurring in air bottles attached to bottle ports 112 and/or in high pressure air channel 113, high pressure relief valve 160 will burst and allow air within high pressure air channel 113 to escape from the bottom of manifold body 110 to atmosphere, thus avoiding the risk of inadvertently delivering over-pressure air into regulator 120, which could damage the components of regulator 120. Importantly, high pressure relief valve receiver 163, and thus high pressure relief valve 160 itself, is pressurized at any time that air bottles connected to manifold system 100 see pressure, thus ensuring that the pressure relief valve 160 cannot be bypassed. Likewise, the downward vertical orientation of high pressure relief valve receiver 163 ensures that in the event that such pressure relief valve 160 bursts, the escaping high pressure air stream is directed downward so as to not cause injury to the operator or damage to other operator-worn equipment.

Preferably blanking plugs 101 are removably positioned in manifold body 110 at opposite ends of high pressure air channel 113 which, when fully installed, seal air channel 113. Such blanking plugs 101 may provide access to air channel 113, thus allowing additional components (sensors, etc.) to be added to manifold system 100.

With continued reference to FIGS. 6, 9, and 10, male quick disconnect 140 may be removably positioned (such as, by way of non-limiting example, through a threaded connection) within quick disconnect fitting port 115. Quick disconnect fitting port 115 is milled into manifold body 110 at a downward angle and in line with an imaginary axis extending through first stage regulator 120, which positions quick disconnect 140 so that its inlet points upward and away from manifold body 110 towards the rear side of manifold body 110. This configuration allows easy connection of a high pressure air supply without interfering with additional equipment that may be carried on the operator's back.

Quick disconnect 140 includes a fitting 141 configured to receive a quick connect adapter from a hose that may supply high pressure air to manifold system 100, and includes a check valve (not shown) of standard configuration to allow airflow into quick disconnect fitting port while preventing air from escaping in the opposite direction. Quick disconnect 140 is sized such that when it is positioned in quick disconnect fitting port 115, the base 142 of quick disconnect 140 is spaced apart from an inner wall of disconnect fitting port 115 so as to define a head space 115*b*, which as explained above receives high pressure air through inlet 115*a* (FIG. 7*a*), and delivers air to first stage regulator 120 through high pressure feed port 116. In the event that on/off valve 170 is closed, such that no air is delivered to head space 115*b* from inlet 115*a* (and thus from bottles attached to bottle ports 112), air may still be provided into first stage regulator by connecting a source of high pressure air to male quick disconnect 140. In this configuration, the external source of air connected to male quick disconnect 140 may allow the operator to use manifold system 100 with such source of air delivering breathable air through first stage regulator 120 instead of air from bottles attached at bottle ports 112, thus allowing air within those bottles to be saved when desired, and/or provide air when such bottle supply is depleted. Likewise, when an external source of air is connected to male quick disconnect 140 and on/off valve is opened, air may flow through quick disconnect 140 into head space 115*b*, out through inlet 115*a* and into high pressure air channel 113, and from high pressure air channel 113 into bottles attached to bottle ports 112 for purposes of refilling those bottles with usable air, all without requiring attachment of a separate recharge assembly 30 (FIG. 1) as required by previously known systems.

Optionally and if desired for certain operations, an adapter (not shown) may alternatively be provided having a bottom portion configured identical to the bottom portion of quick disconnect 140 for removable fitment within quick disconnect fitting port 115, which adapter may then connect, such as by way of a hose, to a remote quick disconnect fitting 140 (such as where a refilling air supply is positioned remotely from an operator that is using the improved manifold system 100).

Figure 7:
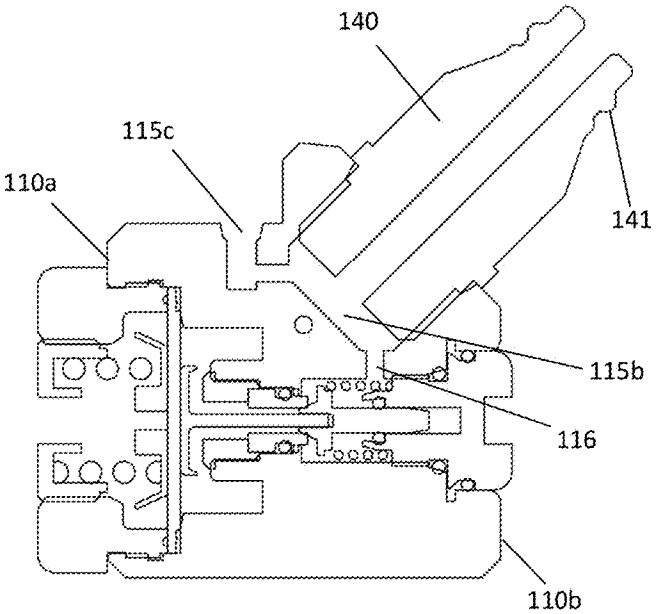
FIG. 7 is a cross-sectional view of the integrated manifold system of FIG. 5 along section line A-A-.
Figure 7A:
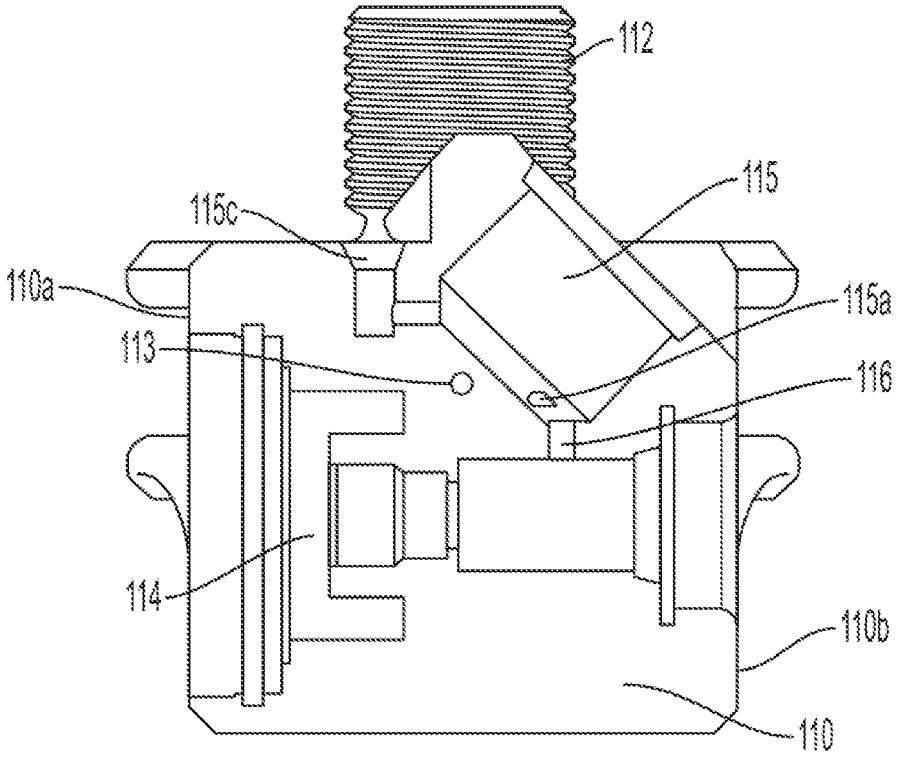
FIG. 7*a* is a cross-sectional view of only the manifold body of FIG. 5 along section line A-A.
Figure 8:
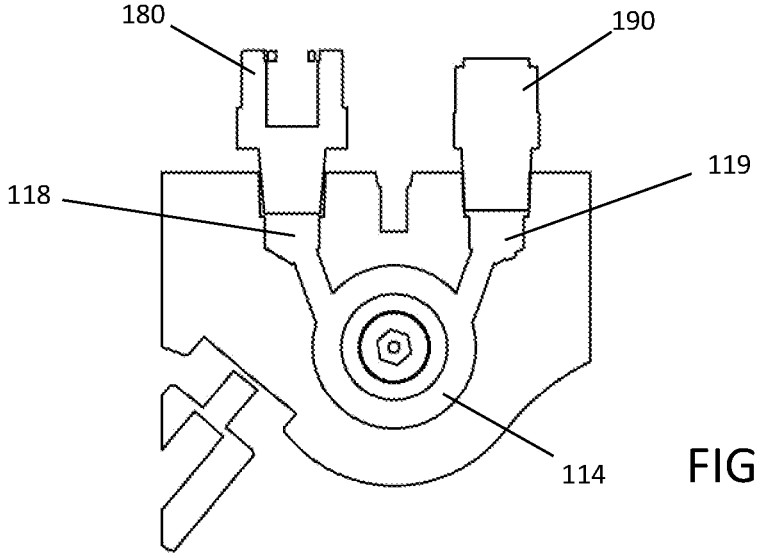
FIG. 8 is a cross-sectional view of the integrated manifold system of FIG. 5 along section line C-C

Still further, and as best viewed in FIG. 7, an auxiliary gauge port 115*c* is preferably milled into manifold body 110 from a top face of manifold body 110 so as to be in fluid communication with head space 115*b*. Gauge port 115*c* may removably receive a gauge (not shown), such as a pressure gauge, through (by way of non-limiting example) a threaded connection. Through positioning of such auxiliary gauge port 115*c* in direct fluid communication with head space 115*b*, a pressure reading is provided that shows actual pressure that is being supplied through high pressure feed port 116 into first stage regulator 120, as opposed to merely providing current air pressure within bottles attached to bottle ports 112. This configuration ensures that the operator has a correct indicator of pressure being supplied to first stage regulator 120 regardless of the condition of the bottles attached to bottle ports 112. In the event that a pressure gauge is not required or desired for a given operation, it may be removed from auxiliary gauge port 115*c* and a removable plug may be placed in auxiliary gauge port 115*c*.

As explained above, and with particular reference to FIGS. 7, 9, and 10, first stage regulator 120 extends through first stage regulator chamber 114 from a front side 110*a* of manifold body 110 to a back side 110*b* of manifold body 110. The portion of regulator 120 that is nearest the back side 110*b* of manifold body 110 comprises the high pressure portion of regulator 120, while the portion that is nearest the front side 110*a* of manifold body 110 comprises the low pressure portion of regulator 120 that feeds air outlet channel 118. Thus, the high pressure side of regulator 120 includes a balance plug 122 at an outer-most portion of regulator 120, a valve 123, and a valve spring 124. A diaphragm lifter 125 extends through a seat support 126 and orifice seat 127 into a head end of valve 123, and at an opposite end engages a diaphragm 128 that controls air flow from first stage regulator chamber 114 of manifold body 110 into outlet channel 118 (and thus to low pressure hose attachment 180). Diaphragm 128 is held against a seat formed by first stage regulator chamber 114 by a diaphragm clamp ring 129, and is biased toward a closed, sealing position by spring 130 and spring carrier 131, the biasing force of which may be adjusted by spring adjuster 132.

Figure 12:
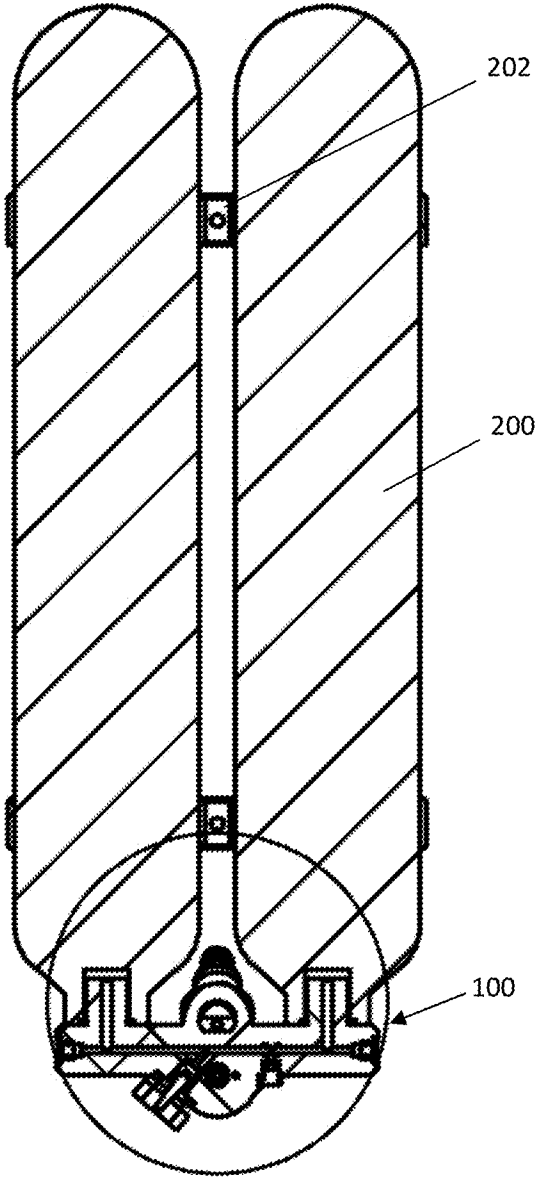
FIG. 12 is a front, cross-sectional view of the manifold system of FIG. 2 including air bottles attached to the manifold body.

As shown in FIG. 12 depicting manifold system 100 with air cylinders 200 positioned thereon, manifold body 110 preferably has a total length dimension that is less than the total width of the air cylinders 200 and a carrier 202 that holds cylinders 200, thus significantly reducing the profile of manifold 100 and allowing far greater maneuverability of the operator over previously known configurations.

As mentioned above, manifold system 100 includes low pressure hose attachment 180 removably attached to outlet channel 118 in manifold body 110 and configured for attachment to a hose to deliver breathable air from the low pressure outlet side of first stage regulator 120 to, by way of non-limiting example, a second stage regulator on an operator's mask. Low pressure hose attachment 180 is positioned to one side of male quick disconnect 140. A quick disconnect fitting of standard configuration may be included on low pressure hose attachment 180, allowing quick connect and quick disconnect of a supply hose (not shown) that, in turn, ultimately delivers breathable air to the operator through, by way of non-limiting example, a respirator mask.

Similarly, low pressure relief valve 190 is configured to allow excess pressure in the low pressure outlet side of first stage regulator 120 to automatically be bled from the low pressure side of first stage regulator 120. Low pressure relief valve 190 is attached to relief valve channel 119 in manifold body 110, which relief valve channel 119 is in fluid communication with the low pressure outlet side of first stage regulator 120. Low pressure relief valve 190 is positioned to a second side of male quick disconnect 140 opposite low pressure hose attachment 180.

The combination disclosed herein of a single, compact, unitary assembly of a manifold body for connecting air supply bottles with a first stage regulator is a significant improvement over previously known systems, as it reduces potential points of failure in the system, reduces overall weight of the system, and eases the burden on the operator by not requiring them to carry and keep track of multiple, separate components for these features. Further beneficial features of the manifold system described herein likewise include the addition of a male quick disconnect 140 enabling cylinder recharge and alternative air supply to that provided by the bottles, an on/off valve 170, and pressure safety devices again all in a single, compact assembly. Previously known systems have typically required separate assemblies with various flow lines among them to achieve these varied functions of a respirator system, and such dispersed components have added size and weight to those systems that make it difficult for the user to operate, particularly in stressful environments. Those skilled in the art will appreciate that a system configured in accordance with the invention will significantly reduce the stress experienced by an operator in a dangerous environment, while ensuring that they have ready and continuous access to a reliable breathable air delivery system.

Figure 11:
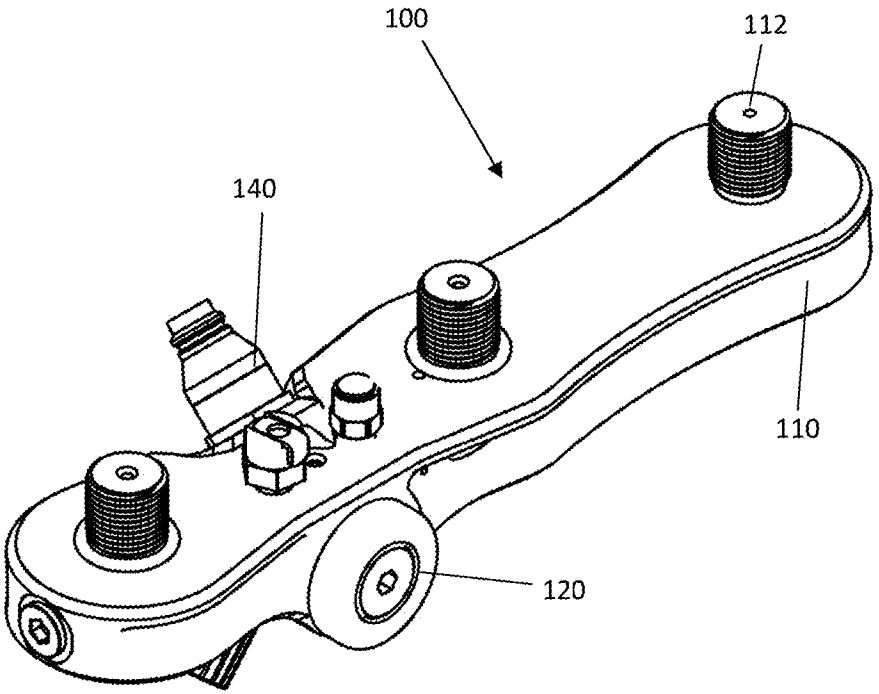
FIG. 11 is a perspective view of an integrated manifold system in accordance with further aspects of an embodiment of the invention.

Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. By way of non-limiting example, and with reference to FIG. 11, manifold body 110 may include more than 2 bottle ports 112 by simply extending the length of manifold body 110 and air channel 113 that interconnects bottle ports 112. Similarly, only one bottle port 112 may be provided to further limit the physical profile of the manifold system 100. It should be understood, therefore, that the invention may be practiced otherwise than as specifically set forth herein.

What is claimed is:

1. An air supply system comprising:

a one-piece manifold body having a top side, a bottom side opposite said top side, a front side extending between said top side and said bottom side, and a back side opposite said front side, said one-piece manifold body further comprising:

a plurality of bottle ports on said top side of said manifold body and each configured to removably receive a bottle of pressurized air;

a first stage regulator chamber extending through said manifold body from said front side to said back side;

an air channel in fluid communication with said bottle ports and said first stage regulator chamber;

an outlet channel in fluid communication with said first stage regulator chamber; and a quick disconnect fitting port positioned between said bottle ports and configured to receive pressurized air from an external source and deliver said pressurized air to said first stage regulator chamber and from said first stage regulator chamber to said plurality of bottle ports and to said outlet channel; and a first stage regulator further comprising a diaphragm and a valve positioned within and operatively engaging said first stage regulator chamber, wherein said first stage regulator extends horizontally through said first stage regulator chamber between the plurality of bottle ports from the front side of said manifold body to the back side of said manifold body.

2. The air supply system of claim 1, further comprising a mask hose quick disconnect attachment in fluid communication with said outlet channel and configured to removably receive an air hose.

3. The air supply system of claim 1, further comprising an on/off valve operatively engaging said air channel to regulate air flow between said at least one bottle port and said first stage regulator chamber.

4. The air supply system of claim 3, wherein a manually operable hand wheel of said on/off valve extends outward from said one-piece manifold body from a bottom side of said one-piece manifold body.

5. The air supply system of claim 4, wherein said on/off valve extends angularly outward from said one-piece manifold body at a non-vertical angle.

6. The air supply system of claim 3, further comprising a quick disconnect fitting removably mounted in said quick disconnect fitting port and configured for connection to an air supply.

7. The air supply system of claim 6, said quick disconnect fitting port defining an open head space between a distal end of said quick disconnect fitting and an internal wall of said quick disconnect fitting port, and said quick disconnect fitting port further comprising an air outlet in fluid communication with an air inlet of said first stage regulator chamber.

8. The air supply system of claim 7, further comprising an air inlet in said quick disconnect fitting port positioned to allow airflow between said head space and said on/off valve.

9. The air supply system of claim 7, further comprising an auxiliary gauge port extending from said head space and defining an opening through a top surface of said one-piece manifold body, wherein said opening through the top surface of said one-piece manifold body is configured to removably receive an auxiliary data gauge.

10. The air supply system of claim 6, wherein said quick disconnect fitting extends upward from a top surface of said one-piece manifold body and toward the back side of said one-piece manifold body.

11. The air supply system of claim 1, further comprising a high pressure relief valve in fluid communication with said air channel.

12. The air supply system of claim 11, wherein said high pressure relief valve extends vertically downward in a from the bottom surface side of said one-piece manifold body.

13. The air supply system of claim 1, wherein said air channel extends horizontally through said manifold body at a normal angle to said first stage regulator chamber, and wherein said at least one bottle port extends vertically away from said air channel.

14. An air supply system, comprising:

a one-piece manifold body having a top side, a bottom side opposite said top side, a front side extending between said top side and said bottom side, and a back side opposite said front side, said one-piece manifold body further comprising:

a plurality of bottle ports on said top side of said manifold body and each configured to removably receive a bottle of pressurized air;

a first stage regulator chamber extending through said manifold body from said front side to said back side;

an air channel in fluid communication with said at least one bottle port bottle ports and said first stage regulator chamber;

an outlet channel in fluid communication with said first stage regulator chamber; and a quick disconnect fitting port positioned between said bottle ports and configured to receive pressurized air from an external source and deliver said pressurized air to said first stage regulator chamber and from said first stage regulator chamber to said plurality of bottle ports and to said outlet channel through said first stage regulator chamber;

a first stage regulator further comprising a diaphragm and a valve positioned within and operatively engaging said first stage regulator chamber, wherein said first stage regulator extends horizontally through said first stage regulator chamber between the plurality of bottle ports from the front side of said manifold body to the back side of said manifold body;

a mask hose attachment in fluid communication with said outlet channel and configured to removably receive an air hose; and an on/off valve operatively engaging said air channel to regulate air flow between said at least one bottle port and said first stage regulator.

15. The air supply system of claim 14, wherein said on/off valve extends outward from said one-piece manifold body from a bottom side of said one-piece manifold body.

16. The air supply system of claim 15, wherein said on/off valve extends angularly outward from said one-piece manifold body at a non-vertical angle.

17. The air supply system of claim 14, further comprising a quick disconnect fitting removably mounted in said quick disconnect fitting port and configured for connection to an air supply.

18. The air supply system of claim 17, said quick disconnect fitting port further defining an open head space between a distal end of said quick disconnect fitting and an internal wall of said quick disconnect fitting port, and said quick disconnect fitting port further comprising an air outlet in fluid communication with an air inlet of said first stage regulator chamber.

19. The air supply system of claim 18, further comprising an air inlet in said quick disconnect fitting port positioned to allow airflow between said head space and said on/off valve.

20. The air supply system of claim 18, further comprising an auxiliary gauge port extending from said head space and defining an opening through a top surface of said one-piece manifold body, wherein said opening through the top surface of said one-piece manifold body is configured to removably receive an auxiliary data gauge.

21. The air supply system of claim 17, wherein said quick disconnect fitting extends upward from a top surface of said one-piece manifold body and toward the back side of said one-piece manifold body.

22. The air supply system of claim 15, further comprising a high pressure relief valve in fluid communication with said air channel.

23. The air supply system of claim 22, wherein said high pressure relief valve extends vertically downward in a from the bottom side of said one-piece manifold body.

24. The air supply system of claim 14, wherein said air channel extends horizontally through said manifold body at a normal angle to said first stage regulator chamber, and wherein said at least one bottle port extends vertically away from said air channel.

* * * * *